US009734701B2

(12) United States Patent
Boss et al.

(10) Patent No.: US 9,734,701 B2
(45) Date of Patent: Aug. 15, 2017

(54) ALTERNATIVE ALARM GENERATOR

(71) Applicant: International Business Machines Corporation, Armonk, NY (US)

(72) Inventors: Gregory J. Boss, Saginaw, MI (US); Harini Jagannathan, San Jose, CA (US); Kevin C. McConnell, Austin, TX (US); Minh Q. Pham, Austin, TX (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 15/001,400

(22) Filed: Jan. 20, 2016

(65) Prior Publication Data

US 2017/0206778 A1 Jul. 20, 2017

(51) Int. Cl.

| | |
|---|---|
| ***G08B 23/00*** | (2006.01) |
| ***G08B 29/18*** | (2006.01) |
| ***G08B 25/00*** | (2006.01) |
| ***G08B 25/10*** | (2006.01) |

(52) U.S. Cl.
CPC ..... *G08B 29/181* (2013.01); *G08B 25/004* (2013.01); *G08B 25/10* (2013.01)

(58) Field of Classification Search
CPC ..... G08B 25/10; G08B 29/181
USPC ..... 340/501, 539.11, 636.1, 309.16; 455/572
See application file for complete search history.

(56) References Cited

U.S. PATENT DOCUMENTS

| | | | |
|---|---|---|---|
| 4,916,438 | A | 4/1990 | Collins et al. |
| 7,505,795 | B1 | 3/2009 | Lim et al. |
| 7,656,287 | B2 | 2/2010 | Albert et al. |
| 7,956,756 | B2 | 6/2011 | Kubey et al. |
| 8,792,854 | B2 | 7/2014 | Craine et al. |
| 9,065,922 | B2 | 6/2015 | Khan |
| 2010/0094103 | A1 | 4/2010 | Kaplan et al. |
| 2011/0128153 | A1 | 6/2011 | Sims et al. |

(Continued)

FOREIGN PATENT DOCUMENTS

| | | | |
|---|---|---|---|
| CN | 1980430 | A | 6/2007 |
| CN | 101909112 | A | 12/2010 |

(Continued)

OTHER PUBLICATIONS

"A smarter and more interactive way to use alarms", An IP.com Prior Art Database Technical Disclosure, Authors et. al.: Disclosed Anonymously, IP.com No. 000224114, Publication Date: Dec. 10, 2012, 4 pages, <http://ip.com/IPCOM/000224114>.

"Adaptive Alarm", An IP.com Prior Art Database Technical Disclosure, Authors et. al.: Disclosed Anonymously, IP.com No. 000211142, Publication Date: Sep. 22, 2011, 6 pages, <http://ip.com/IPCOM/000211142>.

(Continued)

*Primary Examiner* — Phung Nguyen
(74) *Attorney, Agent, or Firm* — Steven Lee Fisher-Stawinski; Steven F. McDaniel

(57) ABSTRACT

A computer-implemented method includes receiving a request. The request is for an alarm. The alarm is emitted from a mobile device. The mobile device is powered by a battery. The battery has a battery level. The method includes receiving a battery level threshold. The method is responsive to the battery level being below the battery level threshold. The method includes identifying an alternative alarm device. The alternative alarm device is enabled with an electronic control channel. The method includes generating an alternative alarm. The method includes sending the alternative alarm to the alternative alarm device via the electronic control channel.

12 Claims, 4 Drawing Sheets

(56) References Cited

U.S. PATENT DOCUMENTS

| | | | | |
|---|---|---|---|---|
| 2013/0040662 | A1* | 2/2013 | Elisco | H04W 52/027 455/456.3 |
| 2013/0090965 | A1 | 4/2013 | Rivere | |
| 2013/0150117 | A1 | 6/2013 | Rodriguez et al. | |
| 2014/0104993 | A1* | 4/2014 | Shields | G04G 13/026 368/74 |
| 2014/0203944 | A1 | 7/2014 | Lombardi et al. | |
| 2015/0061859 | A1 | 3/2015 | Matsuoka et al. | |
| 2015/0208354 | A1* | 7/2015 | Lokhande | H04W 52/0258 455/574 |
| 2015/0212918 | A1* | 7/2015 | Cai | H04W 52/0251 719/318 |
| 2016/0292989 | A1* | 10/2016 | Belk | H04N 21/4126 |

FOREIGN PATENT DOCUMENTS

| | | | |
|---|---|---|---|
| CN | 103607509 | A | 2/2014 |
| CN | 104683573 | A | 6/2015 |
| JP | 2001352394 | A | 12/2001 |
| JP | 2010278576 | A | 12/2010 |
| WO | 0041428 | A1 | 7/2000 |
| WO | 2005083988 | A1 | 9/2005 |

OTHER PUBLICATIONS

"Wake up or trigger alarm on mobile based on certain events", An IP.com Prior Art Database Technical Disclosure, Authors et. al.: Disclosed Anonymously, IP.com No. 000230923, Publication Date: Sep. 18, 2013, 4 pages, <http://ip.com/IPCOM/000230923>.

Mell et al., "The NIST Definition of Cloud Computing", NIST, U.S. Department of Commerce, Special Publication 800-145, Sep. 2011, 7 pages.

Mishra et al., "Smart Travel Alarm—Hybrid app on Sencha 2.2", International Journal of Scientific Research and Management (IJSRM), vol. 2, Issue 7, pp. 1118-1125, Jul. 2014.

Weiner, Sophie, "Smart Alarm Clock for Heavy Sleepers Promises to Get You Out of Bed Fast", FastCodeDesign, 4 Pages, Fast Company & Inc © 2016 Mansueto Ventures, <http://www.fastcodesign.com/3046193/this-smart-alarm-clock-for-heavy-sleepers-promises-to-get-you-out-of-bed-fast>.

Boss et al., "Alternate Alarm Notifications Based on Battery Condition", U.S. Appl. No. 14/996,832, filed Jan. 15, 2016, 49 pages.

IBM, Appendix P, List of IBM Patents or Patent Applications Treated as Related, 2 pages, dated Jan. 28, 2016.

* cited by examiner

ALTERNATIVE ALARM GENERATOR

BACKGROUND

The present invention relates generally to the field of mobile devices and more particularly to alarm systems.

An alarm is a clock that is designed to make a sound or other signal at a specific time. Mobile devices such as cellular phones are often equipped with an alarm clock feature. Alarm systems may utilize aspects of a mobile device, such as speakers or flash alerts, in order to emit the alarm. Alarms may be used to awaken a user. A user may use his or her mobile device to awaken him or her each morning, and thus must be reasonably assured of the alarm's reliability.

SUMMARY

A computer-implemented method includes receiving a request. The request is for an alarm. The alarm is emitted from a mobile device. The mobile device is powered by a battery. The battery has a battery level. The method includes receiving a battery level threshold. The method is responsive to the battery level being below the battery level threshold. The method includes identifying an alternative alarm device. The alternative alarm device is enabled with an electronic control channel. The method includes generating an alternative alarm. The method includes sending the alternative alarm to the alternative alarm device via the electronic control channel. A corresponding computer program product and computer system are also disclosed.

A computer program product includes one or more computer readable storage media and program instructions stored on the one or more computer readable storage media. The program instructions include instructions to receive a request. The request is for an alarm. The alarm is emitted from a mobile device. The mobile device is powered by a battery. The battery has a battery level. The program instructions include instructions to receive a battery level threshold. The program instructions are responsive to the battery level being below the battery level threshold. The program instructions include instructions to identify an alternative alarm device. The alternative alarm device is enabled with an electronic control channel. The program instructions include instructions to generate an alternative alarm. The program instructions include instructions to send the alternative alarm to the alternative alarm device via the electronic control channel.

A computer system includes one or more computer processors. A computer system includes one or more computer readable storage media. A computer system includes computer program instructions. The computer program instructions are stored on the computer readable storage media for execution by at least one of the one or more processors. The computer program instructions include instructions to receive a request. The request is for an alarm. The alarm is emitted from a mobile device. The mobile device is powered by a battery. The battery has a battery level. The program instructions include instructions to receive a battery level threshold. The program instructions are responsive to the battery level being below the battery level threshold. The program instructions include instructions to identify an alternative alarm device. The alternative alarm device is enabled with an electronic control channel. The program instructions include instructions to generate an alternative alarm. The program instructions include instructions to send the alternative alarm to the alternative alarm device via the electronic control channel.

DETAILED DESCRIPTION

Figure 1:
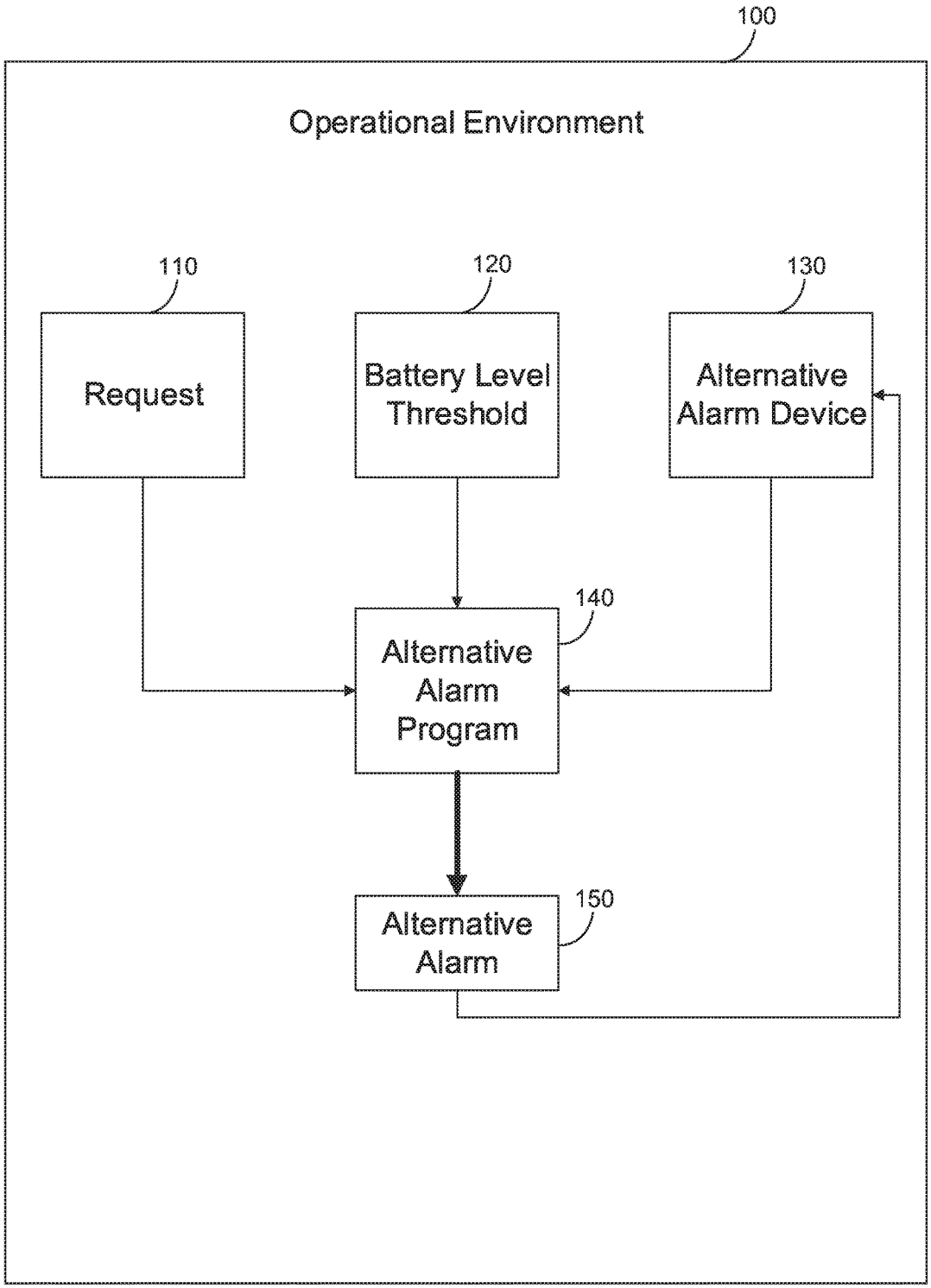
FIG. 1 is a block diagram of an operational environment suitable for operation of an alternative alarm program, in accordance with at least one embodiment of the present invention.

Referring now to the invention in more detail, FIG. 1 is a block diagram displaying an exemplary operational environment suitable for operation of at least one embodiment of the invention, generally designated operational environment 100. The operational environment 100 includes a request 110, a battery level threshold 120, an alternative alarm device 130, an alternative alarm program 140, and an alternative alarm 150, all in mutual communication and interconnected via the operational environment 100. The operational environment 100 may be a cloud-based, virtual, or distributed environment or a remote environment on defined server hardware, or, more generally, the operational environment 100 may be any type of environment suitable for access by the alternative alarm program.

The request 110 is a request for an alarm. The alarm is emitted from a mobile device. The request 110 may include information about when the alarm is to be emitted from the mobile device, at what volume the alarm is to be emitted from the mobile device, and/or how the alarm is to be emitted from the mobile device. For example, the request 110 may include information that a one decibel ringing noise is to be emitted from a mobile device's speaker at 10 am for two minutes. The mobile device is a computing device capable of communicating with the alternative alarm program 140 via the operational environment 100. The mobile device may be a mobile phone, smart phone, tablet, laptop, or personal computer. The mobile device is powered by a battery. Batteries store energy in the form of chemical ions up to a particular capacity for each batter. A battery's level may be understood as the stored charge expressed as a fraction of the capacity. Overtime, the capacity of a battery decreases. For example, a mobile device is battery powered and may have a maximum capacity of one hundred amp-hours. As the mobile device is used the capacity decreases. The capacity at any given time may be understood as the maximum battery level for the mobile device at that given time. The invention recognizes that mobile devices are often battery powered. Users and alarm system designers continue to face difficulties when a mobile device is running low on battery power and a user has set an alarm to awaken him or her.

The battery level threshold 120 is a fixed value. For example, the battery level threshold 120 may be a particular capacity, such as ten amp-hours. In other embodiments, the battery level threshold 120 may be based on a percentage, such as ten percent of the maximum capacity. In some embodiments, the battery level threshold 120 is predetermined. In other embodiments, the battery level threshold 120 is responsive to input from a mobile device user. In other embodiments, the battery level threshold 120 may be determined based on an amount of battery power required to process and perform the request 110.

The alternative alarm device 130 is an electronic device enabled with an electronic control channel. The electronic control channel is interfaced such that the alternative alarm device 130 is in electronic communication with the alternative alarm program 140 via the operational environment 100. The alternative alarm device 130 is capable of communicating with the alternative alarm program 140. For example, the alternative alarm device may be a lighting system in electronic communication with the alternative alarm program 140. The alternative alarm device 130 may be an audio system, a television system, or a radio. In some embodiments, the operational environment 100 may include multiple alternative alarm devices similar to the alternative alarm device 130. The alternative alarm device 130 is capable of receiving the alternative alarm 150 from the alternative alarm program 140 via the alternative alarm device 130.

The alternative alarm 150 is generated as output from the alternative alarm program 140. The alternative alarm 150 may include electronic instructions suitable for processing by the alternative alarm device 130. For example, in embodiments where the alternative alarm device 130 is a lighting system, the alternative alarm 150 may include instructions to turn the lighting system on and off at one second intervals.

The alternative alarm program 140 may receive the request 110, the battery level threshold 120, and the alternative alarm device 130 as input and generate the alternative alarm 150 as output.

Figure 2:
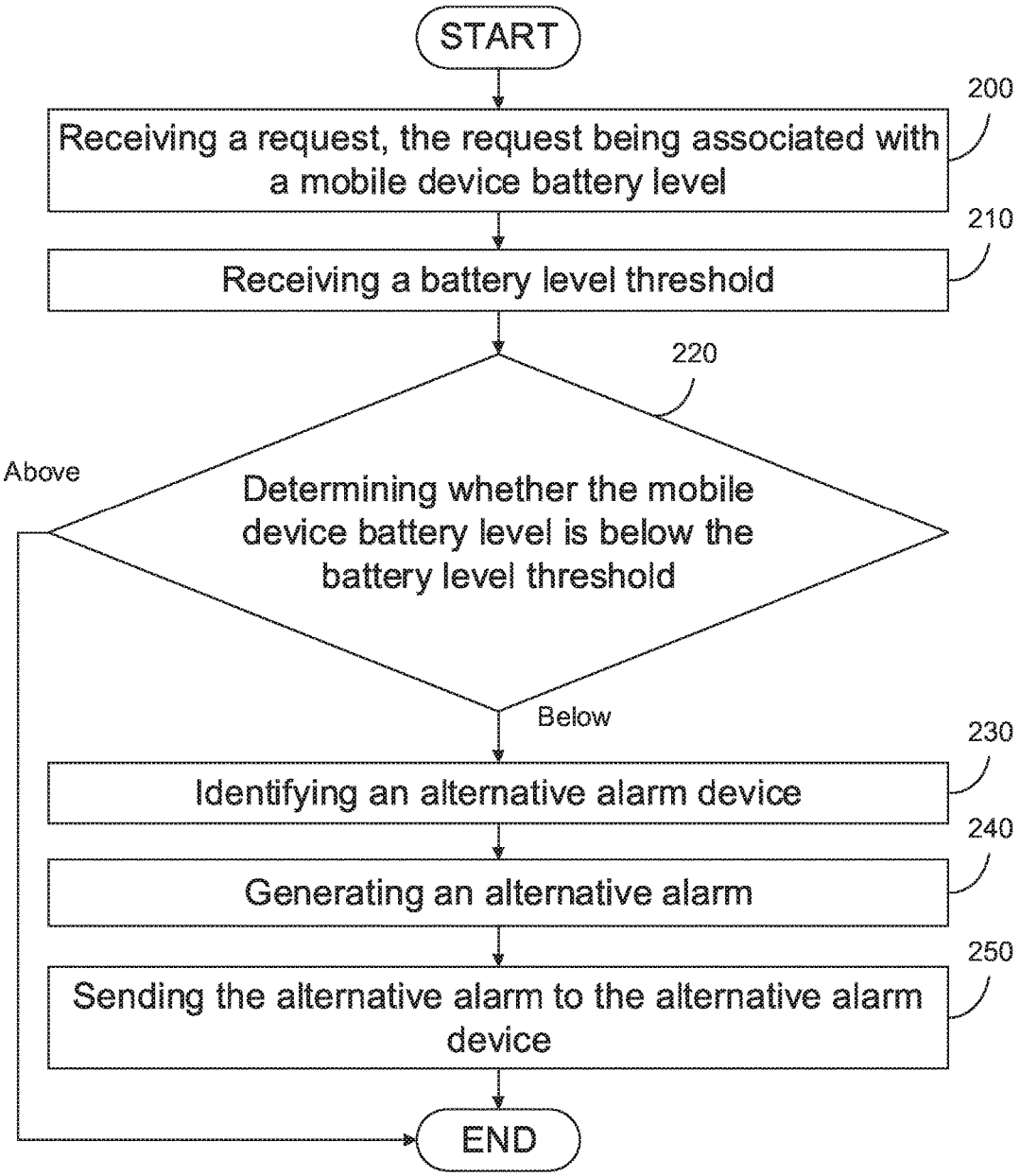
FIG. 2 is a flowchart depicting operational steps for an alternative alarm program, in accordance with at least one embodiment of the present invention.

FIG. 2 is a flowchart depicting the operational steps of the alternative alarm program 140, executing within the operational environment 100 of FIG. 1, in accordance with an embodiment of the present invention.

At step 200, the alternative alarm program 140 receives the request 110, the request 110 being associated with a mobile device battery level. The request 110 is for an alarm. The alarm is configured to be emitted from the mobile device. At any given point the mobile device has a battery level. The battery level may change based on usage. Receiving may include a user explicitly calling the alternative alarm program 140 from a command line interface using a reference to the request 110 as an argument. Alternatively, receiving may include automated calls to the alternative alarm program, for example, from an integrated development environment or as part of an alternative alarm program management system.

At step 210, the alternative alarm program 140 receives the battery level threshold 120. The alternative alarm program 140 may receive the battery level threshold 120 responsive to input from a user of the mobile device. The alternative alarm program 140 may receive the battery level threshold 120 as predetermined input. In some embodiments, the alternative alarm program 140 generates the battery level threshold 120 based on an estimated battery power required to execute the request 110. In some embodiments, the battery level threshold 120 is determined by a separate computing device capable of communicating with the alternative alarm program 140. In such an embodiment, the battery level threshold 120 may be the estimated battery power required to execute the request 110.

At step 220, the alternative alarm program 140 determines whether the mobile device battery level is below the battery level threshold 120. The alternative alarm program 140 may make this determination by comparing two numerical values arithmetically. If the battery level is above the battery level threshold 120 the program exits. In some embodiments, the alternative alarm program 140 may repeat steps 200-220 at regular intervals until the alarm associated with the request 110 is executed. If the battery level is below the battery level threshold 120 the alternative alarm program 140 proceeds to step 230.

At step 230, the alternative alarm program 140 identifies the alternative alarm device 130. The alternative alarm device 130 is enabled with an electronic control channel and is capable of being accessed by the alternative alarm program 140 and receiving input from the alternative alarm program 140 via the operational environment 100.

At step 240, the alternative alarm program 140 generates the alternative alarm 150. The alternative alarm 150 may include instructions that may be sent to the alternative alarm device 130, processed by the alternative alarm device 130, and carried out by the alternative alarm device 130. For example, the alternative alarm 150 may include instructions to turn on a sound system in embodiments where the alternative alarm 150 is a stereo system.

At step 250, the alternative alarm program 140 sends the alternative alarm 150 to the alternative alarm device 130.

Figure 3:
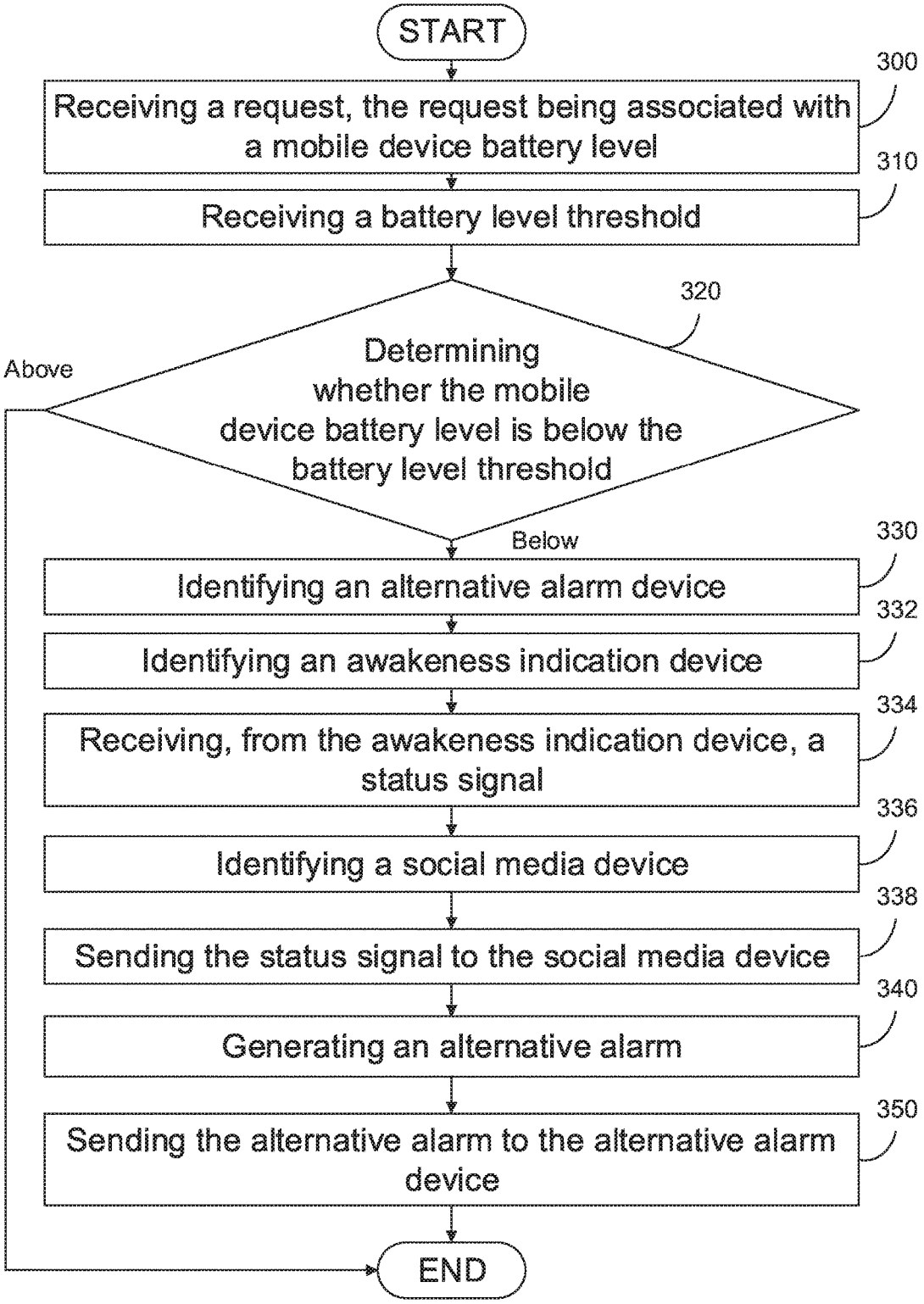
FIG. 3 is a flowchart depicting operational steps for an alternative alarm program receiving a status signal, in accordance with at least one embodiment of the present invention.

FIG. 3 is a flowchart depicting the operational steps of the alternative alarm program 140, executing within the operational environment 100 of FIG. 1, in accordance with an embodiment of the present invention where the alternative alarm program 140 receives an awakeness indication.

The alternative alarm program 140 performs step 300, step 310, step 320, and step 330 similarly to step 200, step 210, step 220, and step 230.

At step 332 the alternative alarm program 140 identifies an awakeness indication device. The awakeness indication device is enabled when an electronic communication system such that the awakeness indication device is in mutual communication with the alternative alarm program 140 via the operational environment 100. The awakeness indication device may be at least one device selected from a group consisting of: a shower, a motion detector, a heartrate monitor, an electronic toothbrush, and a lighting system. The awakeness indication device is responsive to input from a user and capable of determining a status signal based on the input. For example, in embodiments where the awakeness indication device is an electronic toothbrush, the awakeness indication device may determine a status signal based on whether the electronic toothbrush is turned on or not.

At step 334 the alternative alarm program 140 receives the status signal from the alternative alarm device.

At step 336 the alternative alarm program 140 identifies a social media device. The social media device may be an application within a mobile device. The social media device may be a web application accessible via a desktop, mobile, or personal computer. The social media device is capable of communicating with the alternative alarm program 140 via the operational environment 100. The social media device may be an electronic mailing system or a text messaging system.

At step 338 the alternative alarm program 140 sends the status signal to the social media device. For example, in embodiment where the social media device is an electronic mailing system, the alternative alarm program 140 may send the status signal to the electronic mailing system. A user may predetermine which social media devices (if any) are to receive a status signal. A user may also predetermine which social media devices (if any) are to receive a status signal based on what the status signal is. For example, user may predetermine that a status signal should only be sent if the status signal is negative (indicating the user is not awake).

The alternative alarm program 140 performs step 340, and step 350 similar to step 240, and step 250.

In some embodiments, the alternative alarm program 140 may be responsive to the status signal being negative. In such embodiments the alternative alarm program 140 may identify a second alternative alarm device similar to the alternative alarm device 130. The second alternative alarm device may be a different feature of the alternative alarm device 130, such as a different song, in embodiments where the alternative alarm device 130 is a sound system. The second alternative alarm device may be a different device as long as the second alternative alarm device is also enabled with an electronic control channel and capable of communicating with the alternative alarm program 140 via the operational environment 100. In such an embodiment the alternative alarm program 140 may generate a second alternative alarm, similar to the alternative alarm 150 and corresponding to the second alternative alarm device. The alternative alarm program 140 may send the second alternative alarm to the second alternative alarm device.

Figure 4:
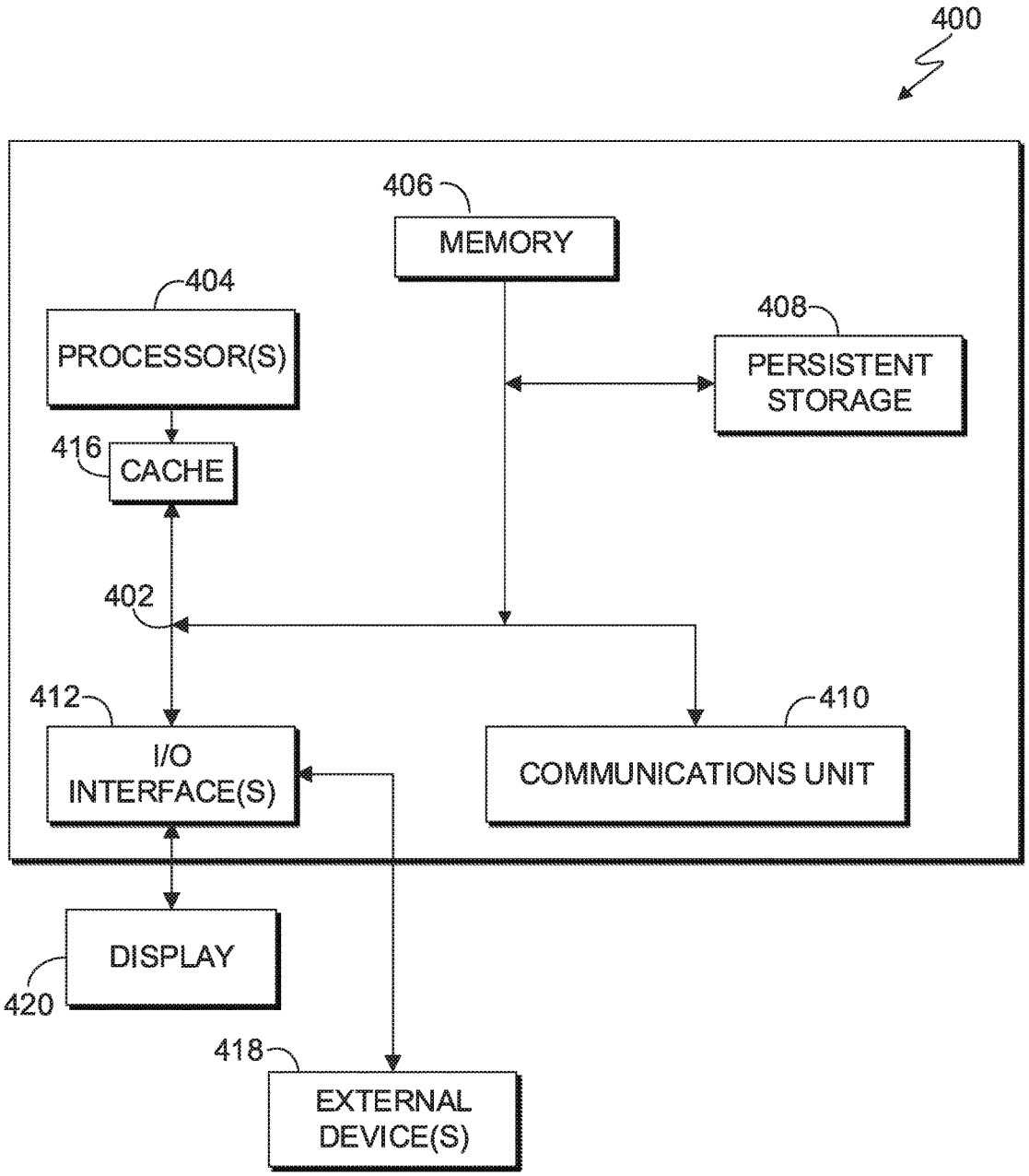
FIG. 4 is a block diagram of components of a computing apparatus suitable for executing an alternative alarm program in accordance with at least one embodiment of the present invention.

FIG. 4 is a block diagram depicting components of a computer 400 suitable for executing the alternative alarm program 140. FIG. 4 displays the computer 400, the one or more processor(s) 404 (including one or more computer processors), the communications fabric 402, the memory 406, the RAM 416, the cache 416, the persistent storage 408, the communications unit 410, the I/O interfaces 412, the display 420, and the external devices 418. It should be appreciated that FIG. 4 provides only an illustration of one embodiment and does not imply any limitations with regard to the environments in which different embodiments may be implemented. Many modifications to the depicted environment may be made.

As depicted, the computer 400 operates over a communications fabric 402, which provides communications between the cache 416, the computer processor(s) 404, the memory 406, the persistent storage 408, the communications unit 410, and the input/output (I/O) interface(s) 412. The communications fabric 402 may be implemented with any architecture suitable for passing data and/or control information between the processors 404 (e.g., microprocessors, communications processors, and network processors, etc.), the memory 406, the external devices 418, and any other hardware components within a system. For example, the communications fabric 402 may be implemented with one or more buses or a crossbar switch.

The memory 406 and persistent storage 408 are computer readable storage media. In the depicted embodiment, the memory 406 includes a random access memory (RAM). In general, the memory 406 may include any suitable volatile or non-volatile implementations of one or more computer readable storage media. The cache 416 is a fast memory that enhances the performance of computer processor(s) 404 by holding recently accessed data, and data near accessed data, from memory 406.

Program instructions for the alternative alarm program 140 may be stored in the persistent storage 408 or in memory 406, or more generally, any computer readable storage media, for execution by one or more of the respective computer processors 404 via the cache 416. The persistent storage 408 may include a magnetic hard disk drive. Alternatively, or in addition to a magnetic hard disk drive, the persistent storage 408 may include, a solid state hard disk drive, a semiconductor storage device, read-only memory (ROM), electronically erasable programmable read-only memory (EEPROM), flash memory, or any other computer readable storage media that is capable of storing program instructions or digital information.

The media used by the persistent storage 408 may also be removable. For example, a removable hard drive may be used for persistent storage 408. Other examples include optical and magnetic disks, thumb drives, and smart cards that are inserted into a drive for transfer onto another computer readable storage medium that is also part of the persistent storage 408.

The communications unit 410, in these examples, provides for communications with other data processing systems or devices. In these examples, the communications unit 410 may include one or more network interface cards. The communications unit 410 may provide communications through the use of either or both physical and wireless communications links. Alternative alarm program 140 may be downloaded to the persistent storage 408 through the communications unit 410. In the context of some embodiments of the present invention, the source of the various input data may be physically remote to the computer 400 such that the input data may be received and the output similarly transmitted via the communications unit 410.

The I/O interface(s) 412 allows for input and output of data with other devices that may operate in conjunction with the computer 400. For example, the I/O interface 412 may provide a connection to the external devices 418, which may include a keyboard, keypad, a touch screen, and/or some other suitable input devices. External devices 418 may also include portable computer readable storage media, for example, thumb drives, portable optical or magnetic disks, and memory cards. Software and data used to practice embodiments of the present invention may be stored on such portable computer readable storage media and may be loaded onto the persistent storage 408 via the I/O interface(s) 412. The I/O interface(s) 412 may similarly connect to a display 420. The display 420 provides a mechanism to display data to a user and may be, for example, a computer monitor.

The programs described herein are identified based upon the application for which they are implemented in a specific embodiment of the invention. However, it should be appreciated that any particular program nomenclature herein is used merely for convenience, and thus the invention should not be limited to use solely in any specific application identified and/or implied by such nomenclature.

The present invention may be a system, a method, and/or a computer program product at any possible technical detail level of integration. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, configuration data for integrated circuitry, or either source code or object code written in any combination of one or more programming languages, including an object oriented programming language such as Smalltalk, C++, or the like, and procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

What is claimed is:

1. A computer-implemented method comprising:

receiving a request, said request being for an alarm, said alarm being emitted from a mobile device, said mobile device being powered by a battery, said battery having a battery level;

identifying an awakeness indication device that is external to the mobile device;

receiving, from said awakeness indication device, a status signal; and conducting an alarm action based on the status signal.

2. The computer-implemented method of claim 1 wherein said awakeness indication device comprises at least one device selected from the group consisting of:

(a) a shower;

(b) a motion detector;

(c) a heartrate monitor;

(d) an electronic toothbrush; and (e) a lighting system.

3. The computer-implemented method of claim 1 further comprising:

identifying at least one social media device; and sending said status signal to said at least one social media device.

4. The computer-implemented method of claim 1 further comprising:

identifying an alternative alarm device;

responsive to said status signal being negative, generating an alternative alarm; and sending said alternative alarm to said alternative alarm device.

5. A computer program product comprising:

one or more computer readable storage media and program instructions stored on said one or more computer readable storage media, said program instructions comprising instructions to:

receive a request, said request being for an alarm, said alarm being emitted from a mobile device, said mobile device being powered by a battery, said battery having a battery level;

identify an awakeness indication device that is external to the mobile device;

receive, from said awakeness indication device, a status signal; and conduct an alarm action based on the status signal.

6. The computer program product of claim 5 wherein said awakeness indication device comprises at least one device selected from the group consisting of:

(a) a shower;

(b) a motion detector;

(c) a heartrate monitor;

(d) an electronic toothbrush; and (e) a lighting system.

7. The computer program product of claim 5 further comprising instructions to:

identify at least one social media device; and send said status signal to said at least one social media device.

8. The computer program product of claim 5 further comprising instructions to:

identify an alternative alarm device;

responsive to said status signal being negative, generate an alternative alarm; and send said alternative alarm to said alternative alarm device.

9. A computer system comprising:

one or more computer processors;

one or more computer readable storage media;

computer program instructions; and said computer program instructions being stored on said computer readable storage media for execution by at least one of said one or more processors, said computer program instructions comprising instructions to:

receive a request, said request being for an alarm, said alarm being emitted from a mobile device, said mobile device being powered by a battery, said battery having a battery level;

identify an awakeness indication device that is external to the mobile device;

receive, from said awakeness indication device, a status signal; and conduct an alarm action based on the status signal.

10. The computer system of claim 9 wherein said awakeness indication device comprises at least one device selected from the group consisting of:

(a) a shower;

(b) a motion detector;

(c) a heartrate monitor;

(d) an electronic toothbrush; and (e) a lighting system.

11. The computer system of claim 9 further comprising instructions to:

identify at least one social media device; and send said status signal to said at least one social media device.

12. The computer system of claim 9 further comprising instructions to:

identify an alternative alarm device;

responsive to said status signal being negative, generate an alternative alarm; and send said alternative alarm to said alternative alarm device.

* * * * *